United States Patent [19]

Lippert

[11] Patent Number: 5,067,432

[45] Date of Patent: Nov. 26, 1991

[54] REPLACEABLE WIPING INSERT FOR SLOT DIE HEAD

[75] Inventor: Harry G. Lippert, Chippewa Falls, Wis.

[73] Assignee: Extrusion Dies, Inc., Chippewa Falls, Wis.

[21] Appl. No.: 527,362

[22] Filed: May 23, 1990

[51] Int. Cl.[5] ..... B05C 3/18

[52] U.S. Cl. ..... 118/413; 118/419; 425/461

[58] Field of Search ..... 118/413, 419, 122, 123, 118/410, 411; 425/461

[56] References Cited

U.S. PATENT DOCUMENTS

| | | | |
|---|---|---|---|
| 3,813,204 | 5/1974 | Gregory | 425/461 |
| 4,023,971 | 5/1977 | Vested | 96/36.3 |
| 4,076,864 | 2/1978 | Wallsten | 427/209 |
| 4,143,187 | 3/1979 | Pilgrim et al. | 118/413 |
| 4,246,335 | 1/1981 | Keogh et al. | 430/278 |
| 4,643,127 | 2/1987 | Wanke | 118/413 |
| 4,679,524 | 7/1987 | Eklund | 118/122 |
| 4,728,539 | 3/1988 | Gane | 427/356 |
| 4,943,451 | 7/1990 | Zimmer | 118/413 |

FOREIGN PATENT DOCUMENTS

| | | | |
|---|---|---|---|
| 300029 | 3/1971 | U.S.S.R. | 118/419 |

*Primary Examiner*—Willard E. Hoag
*Attorney, Agent, or Firm*—Emrich & Dithmar

[57] ABSTRACT

A slot die head for emitting a coating fluid onto a moving web has a slot orifice, the exit end of which is defined by replaceable inserts, the downstream one of which, relative to the direction of web movement, has a wiping flange cantilevered from a hinge portion thereof. The flange is disposed in use in facing relationship with the web and extends downstream from the slot orifice, so as to be resiliently hingedly movable in directions substantially normal to the web surface for maintaining constant shear levels across the coated area.

16 Claims, 3 Drawing Sheets

REPLACEABLE WIPING INSERT FOR SLOT DIE HEAD

BACKGROUND OF THE INVENTION

1. Field of the Invention

The present invention relates to apparatus for applying a coating fluid to a moving web, and particularly to coating apparatus of the type utilizing a slot die head.

2. Description of the Prior Art

It is known to apply coating fluids to moving webs by means of a slot die head for the purpose of achieving an accurate and smooth film of fluid on the web surface. Presently known slot die heads have a slot orifice from which the coating fluid is emitted onto the web. The outlet end of the orifice is defined by a pair of lips, which may be in the form of replaceable lip inserts removably attachable to the die head. One of the lips may be adjustable in directions substantially perpendicular to the slot axis for varying the orifice opening and thereby varying the smoothness and shearing characteristics of the sheet of fluid emitted from the slot orifice.

The lips respectively extend from the orifice upstream and downstream relative to the direction of web movement, the downstream lip serving as a wiping lip for controlling the thickness of the film coating on the web. In order to achieve proper smoothing of the coating fluid, the wiping lip must be positioned extremely close to the web surface to obtain the desired coating effect. The web is typically moved around a backup roll. During the wiping operation, variations in the system parameters such as the roll diameter, roll hardness, web thickness, lip wiping face straightness or pulsing action from the fluid pump will tend to induce differential shear levels into the coating fluid. These differential shear levels will change the smoothing characteristics of the fluid and therefore change the visual appearance of the coating. Also, differing shear levels across a web may induce variations in the performance characteristics of the adhesive-coated web, reducing the uniformity of performance in the end product.

SUMMARY OF THE INVENTION

It is a general object of the present invention to provide an improved apparatus of the slot die head type, which avoids the disadvantages of prior apparatus while affording additional structural and operating advantages.

An important feature of the invention is the provision of apparatus of the type described, which accommodates variations in system parameters which tend to induce differential shear levels in the coating fluid.

In connection with the foregoing feature, it is another feature of the invention to provide an apparatus of the type set forth which adapts to variations in shear levels for maintaining uniformity in the coating film.

In connection with the foregoing features, it is still another feature of the invention to provide an apparatus of the type set forth which includes a wiping lip which is resiliently movable in directions perpendicular to the web surface being coated.

These and other features of the invention are attained by providing in apparatus for applying a coating fluid to a web of material traveling under tension, including a die head having upstream and downstream lips relative to the direction of movement of the web, wherein the lips are spaced from the web and cooperate to define a slot orifice from which coating fluid may be emitted onto a surface of the web, the improvement comprising: means accommodating resilient movement of the downstream lip in directions substantially normal to the surface of the web.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
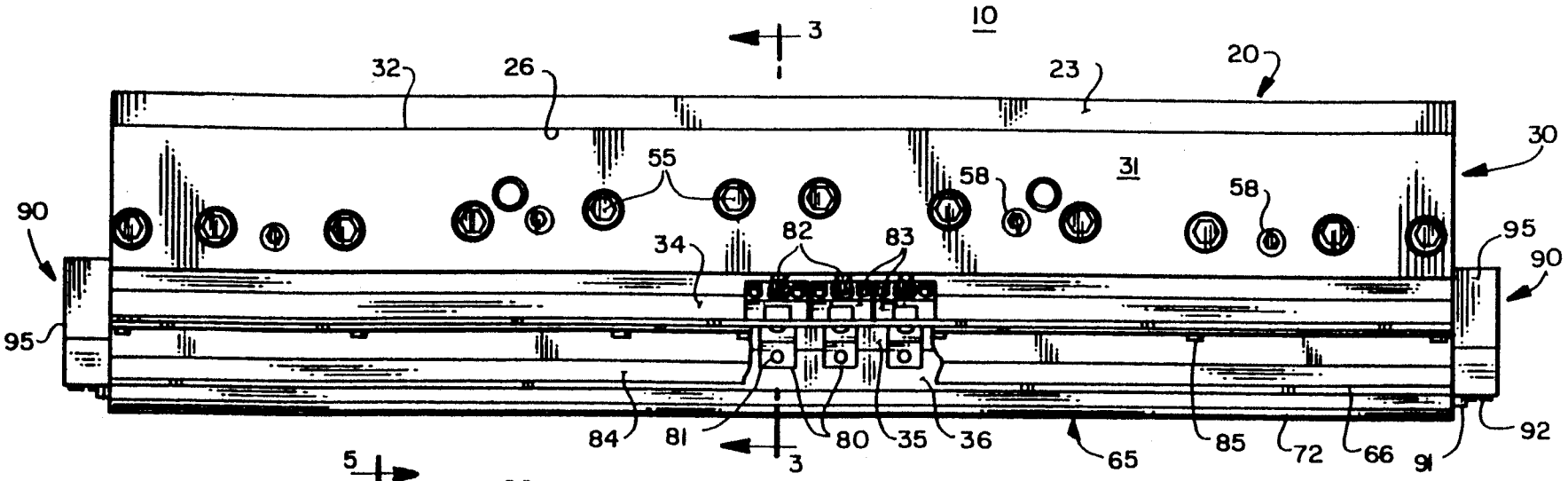
FIG. 1 is a front elevational view of a slot die head utilizing lip inserts constructed in accordance with the present invention, with portions broken away more clearly to illustrate the construction.
Figure 2:
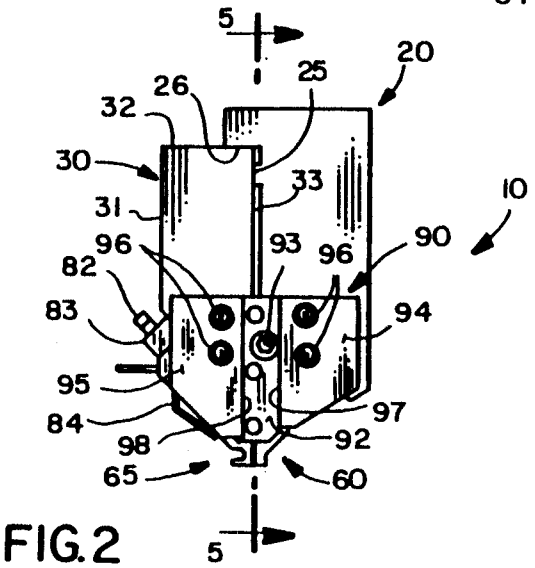
FIG. 2 is an end elevational view of the slot die head of FIG. 1, as viewed from the right-hand end thereof.
Figure 3:
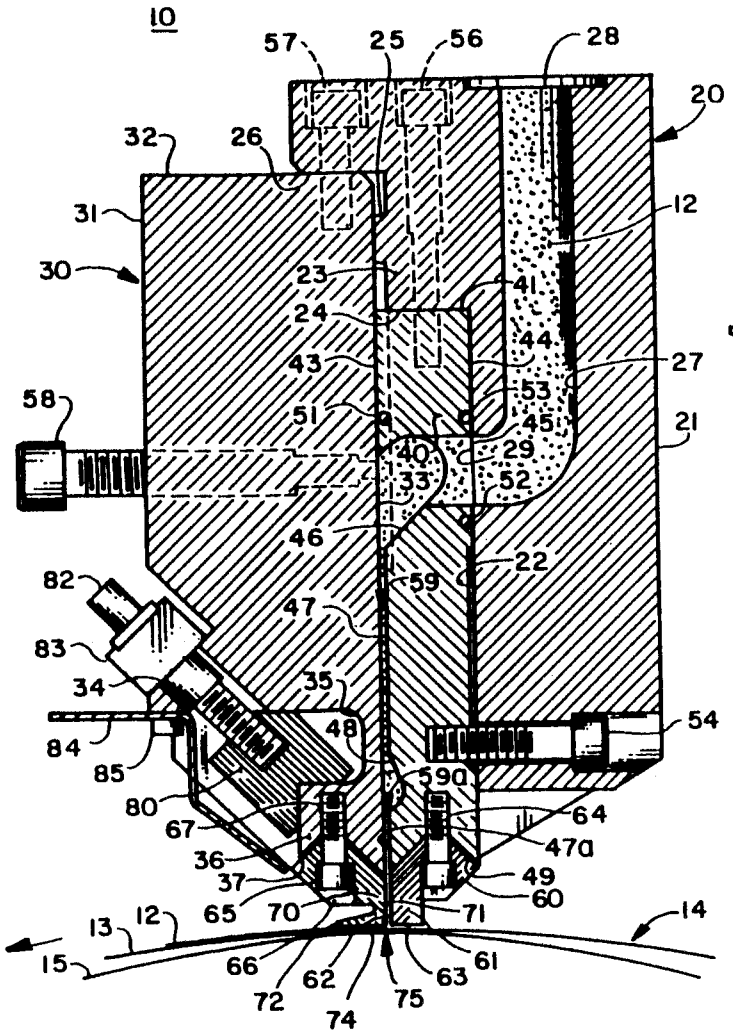
FIG. 3 is an enlarged view in vertical section taken along the line 3—3 in FIG. 1 and illustrating the operation of the slot die head in coating a moving web carried by a backup roll.

Referring to FIGS. 1-3, there is illustrated a slot die head, generally designated by the numeral 10, designed for emitting a stream of heated or ambient temperature coating fluid 12 onto the surface 13 of a moving web 14 as it passes over a backup roll 15. The slot die head 10 includes bodies 20 and 30 which are secured together and clamp therebetween a manifold 40, each of these members being elongated (see FIG. 1) and having a length substantially the same as the width of the web 14 being coated.

The body 20 has a flat, outer surface 21 and a flat, inner surface 22 which is substantially parallel to the surface 21 and of a lesser vertical extent, the upper end of the inner surface 22 terminating at a forwardly projecting overhang portion 23 which defines a shoulder 24. Projecting forwardly from the front of the overhang portion 23 is a spacer land 25. A horizontal shoulder 26 is defined at the upper forward end of the body 20 above the land 25. A generally L-shaped channel 27 is formed through the body 20 and extends from an entry port 28 in the top surface of the body 20 to an exit port 29 in the inner surface 22.

The body 30 has parallel front and rear surfaces 31 and 33 interconnected by a flat top surface 32. Formed in the front surface 31 at the lower end thereof is a notch or cutout which defines an inclined shoulder 34. Extending into the body 30 beneath the shoulder 34 from the front surface 31 to a slight distance forwardly of the rear surface 33 is an enlarged notch 35. A foot 36 depends below the notch 35, the bottom of the foot 36 in turn being cut out to define a notch 37 which has an inverted V shape in transverse cross section. All of the above-described portions of the bodies 20 and 30 extend the entire length thereof.

Figure 5:
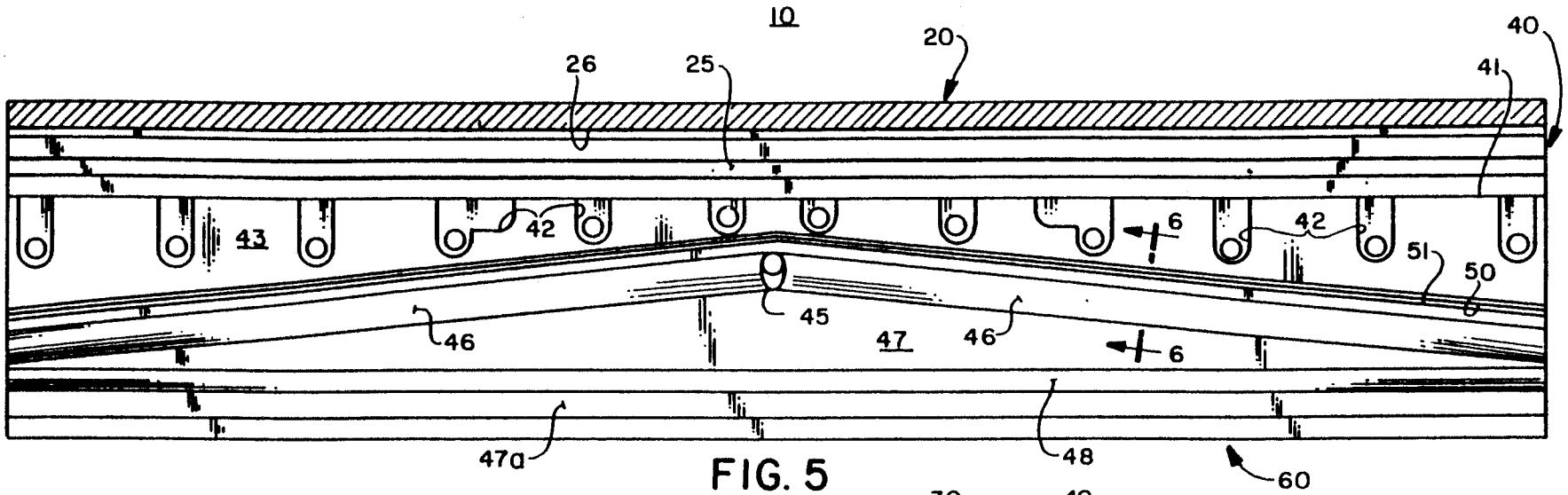
FIG. 5 is an enlarged view in vertical section taken along the line 5—5 in FIG. 2, with the end plates removed.
Figure 6:
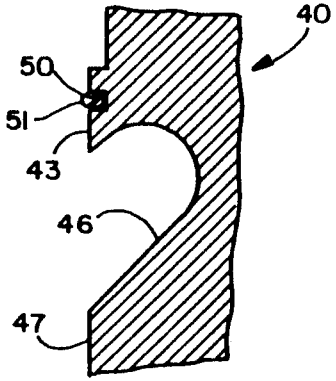
FIG. 6 is a further enlarged fragmentary view taken along the line 6—6 in FIG. 5.

Referring now also to FIGS. 5 and 6, the manifold 40 has an upper end surface 41 which has a plurality of notches 42 formed therein at longitudinally spaced-apart locations therealong. Each of these notches 42 extends through the thickness of the manifold 40, from a front face 43 to a parallel rear face 44. Formed in the rear face 44 substantially midway between the opposite ends of the manifold 40 is a port 45 which communicates with an elongated channel 46 which opens at the front face 43 and which, in transverse cross section, has generally the shape of the hook portion of a coat hanger. The channel 46 extends from the port 45 to the opposite ends of the manifold 40 and slopes gradually downwardly from the port 45, so as generally to define a shallow inverted V, as is best illustrated in FIG. 5. The portion of the front face 43 beneath the channel 46 is relieved a slight distance to define a recessed surface 47. Formed in the recessed surface 47 toward the lower end thereof is a cavity 48, which extends for the length of the manifold 40. A portion 47a of the recessed surface 47 below the cavity 48 is recessed a lesser distance than is the remainder of the recessed surface 47. The bottom end of the manifold 40 has formed therein a notch 49 which is generally in the shape of an inverted V and extends the length of the manifold 40 (FIG. 3). Formed in the front face 43 immediately above the channel 46 and extending the length thereof is a groove 50 in which is seated a seal gasket 51. An annular groove 52 is formed in the rear face 44 in encircling relationship with the port 45 and receives therein an O-ring seal 53 (FIG. 3).

In assembly, the manifold 40 is disposed with its rear face 44 against the inner surface 22 of the body 20 with the ports 29 and 45 in registry, and with the end surface 41 of the manifold 40 seated against the shoulder 24. The O-ring 53 seals the interface between the body 20 and the manifold 40 around the perimeter of the aligned ports 29 and 45. The front face 43 of the manifold 40 will then be substantially coplanar with the front face of the spacer land 25. The body 30 is then disposed with its rear surface 33 against the spacer land 25 and the front face 43 of the manifold 40, and with its top surface 32 seated against the shoulder 26. The seal gasket 51 seals the interface between the body 20 and the manifold 40 above the channel 46. The manifold 40 is secured to the inner surface 22 of the body 20 by a plurality of seat screws 54. The bodies 20 and 30 and the manifold 40 are secured together by a plurality of body bolts 55 (FIG. 1). The manifold 40 is secured to the shoulder 24 by a plurality of manifold bolts 56; and the body 30 is secured to the shoulder 26 by a plurality of seat screws 57.

When thus configured, as illustrated in FIG. 3, it can be seen that the recessed surface 47 of the manifold 40 is spaced slightly from the rear surface 33 of the body 30 to define a passage or channel 59 which communicates with the channel 46 along its entire length. The passage 59 has increased depth at the region of the cavity 48. The portion 47a of the recessed surface 47 cooperates with the rear surface 33 of the body 30 to define a slot 59a which is narrower than the passage 59 and also extends the length of the manifold 40.

A plurality of jack bolts 58 extend through complementary bores in the body 30 and bear against the front face 43 of the manifold 40 for adjusting the thickness of the passage 59.

Seated in the notch 49 of the manifold 40 is a lip insert 60 which extends the length of the manifold 40. The lip insert 60 has a depending lip 61 which has a slot surface 62 which is coplanar with the portion 47a of the recessed surface 47 of the manifold 40. Formed on the bottom end of the lip 61 and disposed substantially perpendicular to the slot surface 62 is a flat planar wiping surface 63 which extends from the surface 62 rearwardly. The lip insert 60 is secured in place by a plurality of screws 64.

Figure 7:
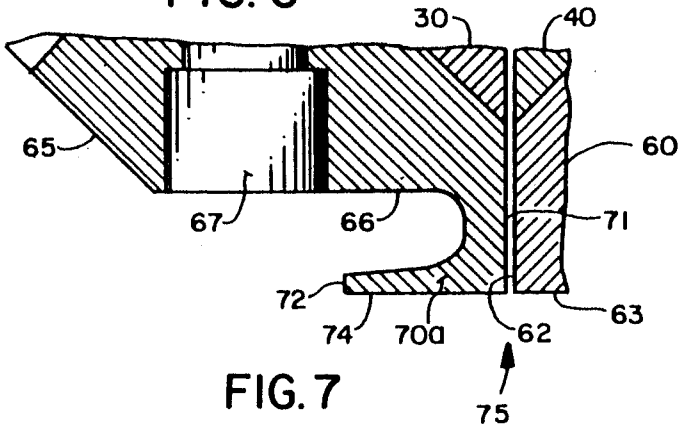
FIG. 7 is a still further enlarged view of the lower portion of FIG. 3, illustrating the lip inserts in accordance with the present invention.

Similarly, a lip insert 65 is seated in the notch 37 at the lower end of the body 30 and extends the length thereof. The lip insert 65 has a lower surface 66 (FIG. 7) which is disposed substantially parallel to the wiping surface 63 and is spaced thereabove. The lip insert 65 is secured in place by a plurality of screws 67. The lip insert 60 includes a hinge portion 70 (FIG. 3) which depends from the lower surface 66 at the end thereof adjacent to the slot 59a and defines a slot surface 71 which is disposed substantially coplanar with the rear surface 33 of the body 30. Unitary with the hinge portion 70 and projecting forwardly therefrom in cantilever fashion is a flexible lip 72, which has a flat planar wiping surface 74 which is disposed, in use, substantially coplanar with the wiping surface 63 of the lip insert 60. It will be appreciated that the slot surfaces 62 and 71 of the lip inserts 60 and 65 cooperate to form an extension of the slot 59a which opens at a slot orifice 75 between the wiping surfaces 63 and 74 (FIG. 4).

Mounted on the body 30 are a plurality of lip adjusting blocks 80, which are fitted in the notch 35 and bear against the foot 36, being fixedly secured thereto by screws 81 (see FIG. 1). The lip adjusting blocks 80 are spaced apart longitudinally of the body 30 and each threadedly receives therein an adjusting screw 82, which is also engaged with an adjusting nut 83 which bears against the shoulder 34. By adjustment of the adjusting screws 82, the pressure applied on the foot 36 by the lip adjusting blocks 80 can be varied, serving to vary the deflection of the foot 36 toward and away from the lower end of the manifold 40, thereby adjusting the thickness of the slot 59a. The adjusting blocks 80 are covered by an elongated cover 84 which is fixedly secured to the body 30 by screws 85.

The opposite ends of the channel 46 in the manifold 40 are respectively closed by end plate assemblies 90, which are constructed as mirror images of each other so that only one will be described in detail. Each of the end plate assemblies 90 includes a seal gasket 91 (FIG. 1) which is fitted against the adjacent end surfaces of the bodies 20 and 30 and the manifold 40 for providing a fluid-tight seal of the adjacent end of the channel 46. The gasket 91 is held in place by a pressure plate 92 which is secured by bolts 93 and is further retained in place by end plates 94 and 95 disposed on either side thereof. More particularly, each of the end plates 94 and 95 is secured to the associated body 20 or 30 by bolts 96, the end plates 94 and 95 respectively having flange portions 97 and 98 which overlie the adjacent edges of the pressure plate 92 for retaining it in place (FIG. 2).

Figure 4:
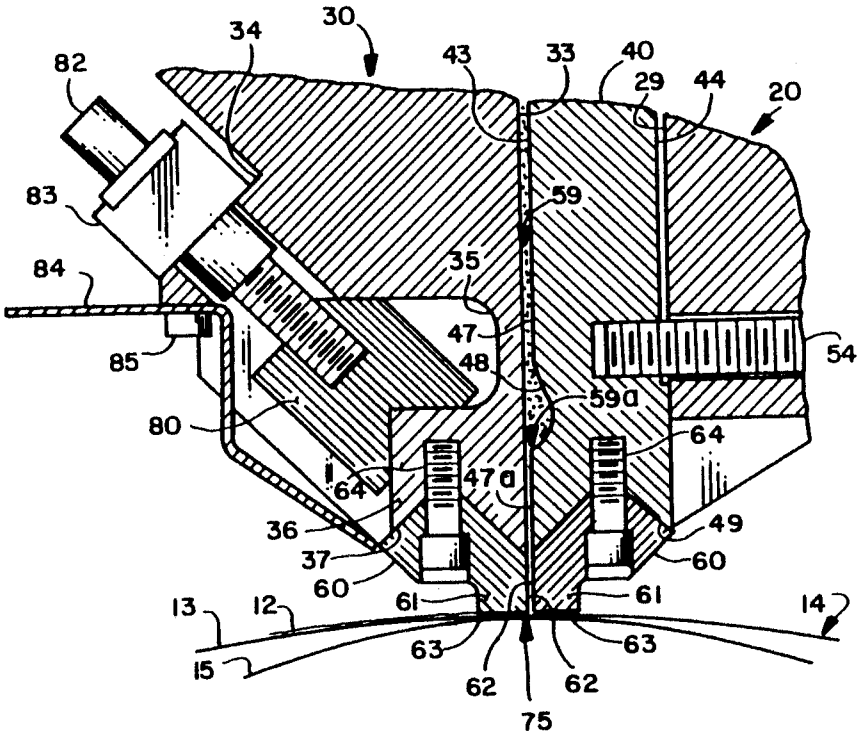
FIG. 4 is a further enlarged, fragmentary view, similar to FIG. 3, illustrating the slot die head with prior art lip inserts.

Referring to FIG. 4, the slot die head 10 is illustrated with a prior art lip insert arrangement in which a lip insert 100 replaces the lip insert 65. While the lip insert 100 is disclosed as substantially the mirror image of the lip insert 60, it will be appreciated that different designs could be used for different coating fluids.

The operation of the slot die head 10 will now be described in detail. It will be appreciated that the entry port 28 of the channel 27 is, in use, coupled to an associated source of coating fluid. This fluid flows through the channel 27 and the ports 29 and 45 into the center of the channel 46, and thence downwardly along the channel 46 toward the opposite ends of the manifold 40. The coating fluid 12 flows from the channel 46 downwardly through the narrow passage 59 along its entire length, and thence into the still narrower slot **59*a* and out through the slot orifice 75, from which it is dispensed in a thin coating onto the surface 13 of the web 14. Since the web 14 is moving in the direction of the arrow indicated in FIG. 3, the stream of coating fluid 12 flows out onto the surface 13 and forms a coating on that portion of the surface 13 which is downstream from the slot orifice 75, relative to the direction of movement of the web 14. It can be seen that the slot orifice 75 is disposed very close to the surface 13 being coated, so as to dispense a very thin coating along the entire width of the web 14**.

In the prior art arrangement, like that illustrated in FIG. 4, in the event of variations in system parameters, such as the diameter of the roll 15, the thickness of the web 14, pulsations in the pump supply of the coating fluid or the like, differential shear levels may be introduced into the coating fluid because the slot die head 10, and in particular the lip inserts 60 and 100, are fixed and rigid and are incapable of yielding in response to the varying system parameters. This can result in unevenness in the coating being applied to the web.

In the present invention, as embodied in the lip inserts 60 and 65 illustrated in FIG. 3, the wiping surface 74 serves to define, by its relative spacing from the web 14, the thickness of the coating being applied. In the event of variations in system parameters, the cantilever construction of the flexible lip 72 permits it to flex relative to the hinge portion 70 in directions substantially normal to the surface of the web 14. Thus, the lip insert 65 yields to accommodate the variations in system parameters, serving to maintain the desired shear levels and coating thickness, resulting in a more uniform coating. The lip inserts 60 and 65 are selectively detachable from the die head 10 so that they can be readily replaced in the event that they wear out or are damaged, or in the event it is desired to use an alternative size or shape lip for a different type application.

From the foregoing, it can be seen that there has been provided an improved coating apparatus, which is of relatively simple and economical construction and yet affords a flexible response to variations in system parameters so as to effectively maintain a uniform coating.

I claim:

1. In apparatus for applying a coating fluid to a web of material traveling under tension, including a die head having upstream and downstream lips relative to the direction of movement of the web, wherein the lips cooperate to define a slot orifice from which coating fluid may be emitted onto a surface of the web, the improvement comprising: means removably attaching the downstream lip to the die head, means accommodating resilient movement of the downstream lip independently of the upstream lip in directions substantially normal to the surface of the web in response to differential shear levels in the coating fluid.

2. The apparatus of claim 1, wherein said downstream lip is flexibly cantilevered from the die head.

3. The apparatus of claim 2, wherein said downstream lip is attached at one end thereof to the die head, said means accommodating resilient movement including a hinge portion at the attached end accommodating resilient movement of said downstream lip.

4. The apparatus of claim 3, wherein said downstream lip and said hinge portion are integral with the die head.

5. The apparatus of claim 1, wherein said downstream lip includes a substantially flat, planar wiping surface disposed in facing relationship with the associated web.

6. The apparatus of claim 5, wherein said wiping surface is disposed substantially perpendicular to the slot orifice and extends downstream therefrom.

7. Apparatus for applying a coating fluid to a web of material traveling under tension, comprising: a die head defining a slot orifice from which a coating fluid may be emitted onto a surface of the web, a wiping lip extending from the slot orifice downstream relative to the direction of web travel, means removably attaching said wiping lip to said die head, and hinge means accommodating resilient movement of said wiping lip independently of said die head in directions substantially normal to the surface of the web in response to differential shear levels in the coating fluid.

8. The apparatus of claim 7, wherein said wiping lip is flexibly cantilevered from said die head.

9. The apparatus of claim 8, wherein said hinge means is disposed at one end of said wiping lip and accommodates pivotal movement thereof.

10. The apparatus of claim 7, wherein said wiping lip defines a portion of said slot orifice.

11. The apparatus of claim 7, wherein said wiping lip is disposed substantially perpendicular to said slot orifice and extends downstream therefrom.

12. A removable lip insert for attachment to a die head for cooperation with another lip portion of the head to define a slot orifice from which coating fluid may be emitted, said insert comprising: a body adapted for removable attachment to the associated die head, a lip flange projecting from said body and having a wiping surface disposable in use in facing relationship with the associated web, and hinge means on said body accommodating resilient movement of said lip flange independently of the other lip portion in directions substantially normal to said wiping surface in response to differential shear levels in the coating fluid.

13. The lip insert of claim 12, and further comprising fastening means for securing said body to the die head.

14. The lip insert of claim 12, wherein said lip flange is flexibly cantilevered from said body.

15. The apparatus of claim 12, wherein said lip flange and said hinge means are of unitary construction with said body.

16. The lip insert of claim 12, wherein said wiping surface is disposed substantially perpendicular to the slot orifice and extends downstream therefrom.

* * * * *